United States Patent [19]

Bobrick

[11] 4,162,014

[45] Jul. 24, 1979

[54] VERTICAL FILE CONSTRUCTION

[75] Inventor: Mitchell Bobrick, Los Angeles, Calif.

[73] Assignee: Eldon Industries, Inc., Hawthorne, Calif.

[21] Appl. No.: 797,335

[22] Filed: May 16, 1977

[51] Int. Cl.[2] ..... A47F 7/00

[52] U.S. Cl. ..... 211/50; 211/55; 211/126

[58] Field of Search ..... 211/50, 52, 55, 126, 211/128, 194

[56] References Cited

U.S. PATENT DOCUMENTS

| | | | |
|---|---|---|---|
| 386,964 | 7/1888 | Cochran | 211/55 |
| 792,427 | 6/1905 | Knudsen | 211/55 |
| 864,761 | 8/1907 | Erickson | 211/55 |
| 1,156,401 | 10/1915 | Hawley | 211/50 X |
| 1,713,147 | 5/1929 | Ruze | 211/50 |
| 1,715,078 | 5/1929 | Whyte et al. | 211/50 |
| 2,909,287 | 10/1959 | Galassi | 211/55 |
| 4,074,810 | 2/1978 | Juergens et al. | 211/126 X |

*Primary Examiner*—Roy D. Frazier
*Assistant Examiner*—Robert W. Gibson, Jr.
*Attorney, Agent, or Firm*—Edward D. O'Brian

[57] ABSTRACT

A composite letter file consists of a primary tray member defining a letter receptacle and having detent means thereupon for engagement by corresponding detent means on a secondary tray member. A plurality of secondary tray members can be secured to one another and supported from the primary tray member which has supporting means associated therewith adapted to maintain it in operative relationship with a supporting surface. The sidewalls of the secondary tray member are resilient to permit them to be sprung outwardly to permit the mutual engagement of the detent means of said secondary tray member with the corresponding detent means of said primary tray member.

7 Claims, 9 Drawing Figures

VERTICAL FILE CONSTRUCTION

BACKGROUND OF THE INVENTION

The problem of providing a temporary receptacle for letters and other documents in the office of a busy executive has long confronted the art and the most common solution for the problem is the provision of the well-known IN and OUT trays which are commonly found on the crowded desk of a busy executive or secretary.

The prior art IN and OUT trays, in addition to occupying considerable desk space, also are inadequate in that numerous documents and letters are stacked on top of one another and are not readily accessible.

It has been suggested in the prior art, U.S. Pat. No. 3,515,283, that a plurality of partition members be provided in a common receptacle to permit a rational segregation of the documentary material. However, such receptacles as described in the above-mentioned patent constitute trays which are adapted to be utilized in the same manner as the commonly utilized and previously mentioned IN and OUT trays.

OBJECTS AND ADVANTAGES OF THE INVENTION

The present invention is directed to a composite letter file which is adapted to be mounted on a vertical supporting surface adjacent the desk of the executive or secretary utilizing the composite letter file. For instance, the composite letter file of the invention can be supported from a wall surface or can, if desired, be supported from a vertically oriented pylon or other vertical support member which is disposed adjacent the desk of the executive or secretary.

Consequently, the surface of the executive or secretary's desk is not encumbered with the trays of the composite letter file and the documents and letters can be placed in a rational relationship with one another in the primary and secondary trays which constitute the composite letter file.

It is, therefore, an object of my invention to provide a composite letter file of the upper-mentioned character which consists of a primary tray member having supporting means associated therewith permitting the primary tray member to be demountably supported upon a vertical or other supporting surface, said primary tray member providing a document-receiving receptacle and having detent means thereupon. A secondary tray member is cooperative with the primary tray member and has detent means thereupon engageable with the corresponding detent means of said primary tray member to permit the secondary tray member to be demountably supported upon said primary tray member.

A desired number of secondary tray members can be supported from one another by interengagement of the detent means thereupon, thus providing a relatively large capacity which permits the rational segregation of correspondence or other documentary material and visual access thereto since the documents are not piled one on top of the other as they are in conventional trays.

Another object of my invention is the provision of a composite letter file of the aforementioned character wherein the detent means on the primary and secondary tray members are constituted by elongated receptacles on the primary tray member and corresponding elongated projections on the secondary tray member engageable with said elongated receptacles on said primary tray member.

As associated object of my invention is the provision of elongated projections on the sidewalls of the secondary tray member, said sidewalls being momentarily displaceable because of the inherent resilience of the material thereof to permit the interengagement of the elongated projections on said sidewalls with the corresponding receptacles on the primary tray member.

Consequently, it is possible to expand the capacity of the composite letter file by merely adding additional secondary tray members to those already supported from one another and from the primary tray member. It is also possible to remove one or more of the secondary tray members from operative relationship with the other members of the composite letter file to permit documentary material which has been handled to be filed or otherwise consigned to different locations.

Other objects and advantages of the invention will be apparent from the description of selected embodiments thereof appearing hereinbelow.

DESCRIPTION OF THE PREFERRED EMBODIMENTS

A composite vertical file 10 constructed in accordance with the teachings of the invention is shown in FIGS. 1–8 of the drawings as including a primary tray member 14 and a plurality of secondary tray members 12 secured in operative relationship with one another, in a manner to be disclosed in greater detail below, and providing a plurality of receptacles for letters, documents or similar materials. The composite vertical file is supported from a vertical surface 16 such as a wall surface located in proximity to a desk or other work surface. Although the composite vertical file 10 is illustrated, for purposes of convenience, as supported from a vertically oriented wall surface, it will be obvious to those skilled in the art that it may be supported from any vertically oriented surface such as a pylon, or may, if desired, be secured to the wall of a cabinet or the like.

Consequently, the vertical file 10 of the invention is far more flexible in its utilization than prior art devices of the desk tray type since a much greater capacity limited only by the vertical height of the supporting surface is afforded and since the individual documents may be segregated logically or alphabetically, as desired.

Figure 1:
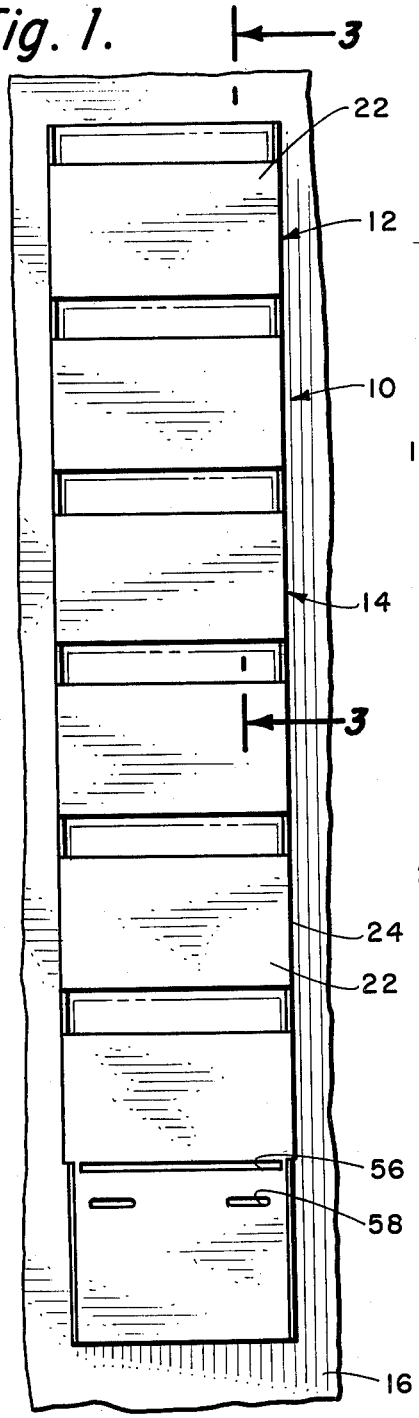
FIG. 1 is a front elevational view of a composite letter file of the invention.
Figure 2:
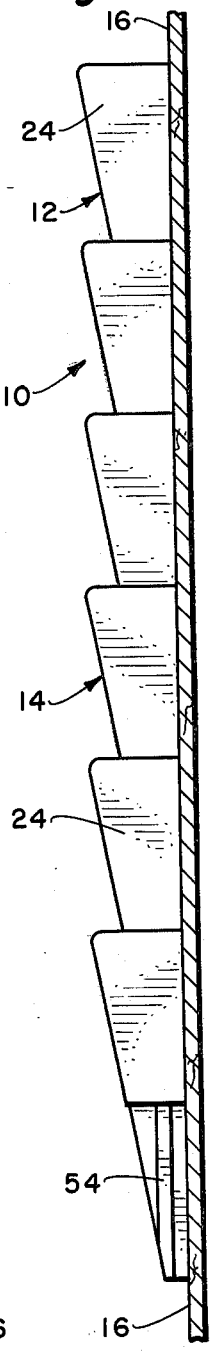
FIG. 2 is a side elevational view showing the composite letter file of the invention supported from a planar vertical surface, such as a wall.
Figure 3:
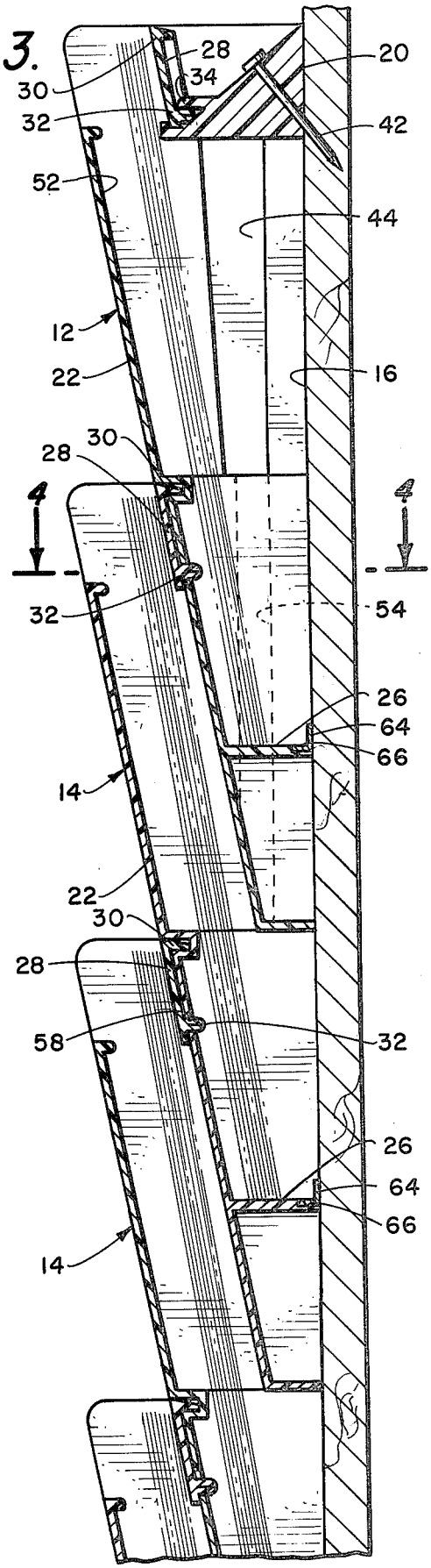
FIG. 3 is an enlarged fragmentary sectional view taken on the broken line 3—3 of FIG. 1.
Figure 5:
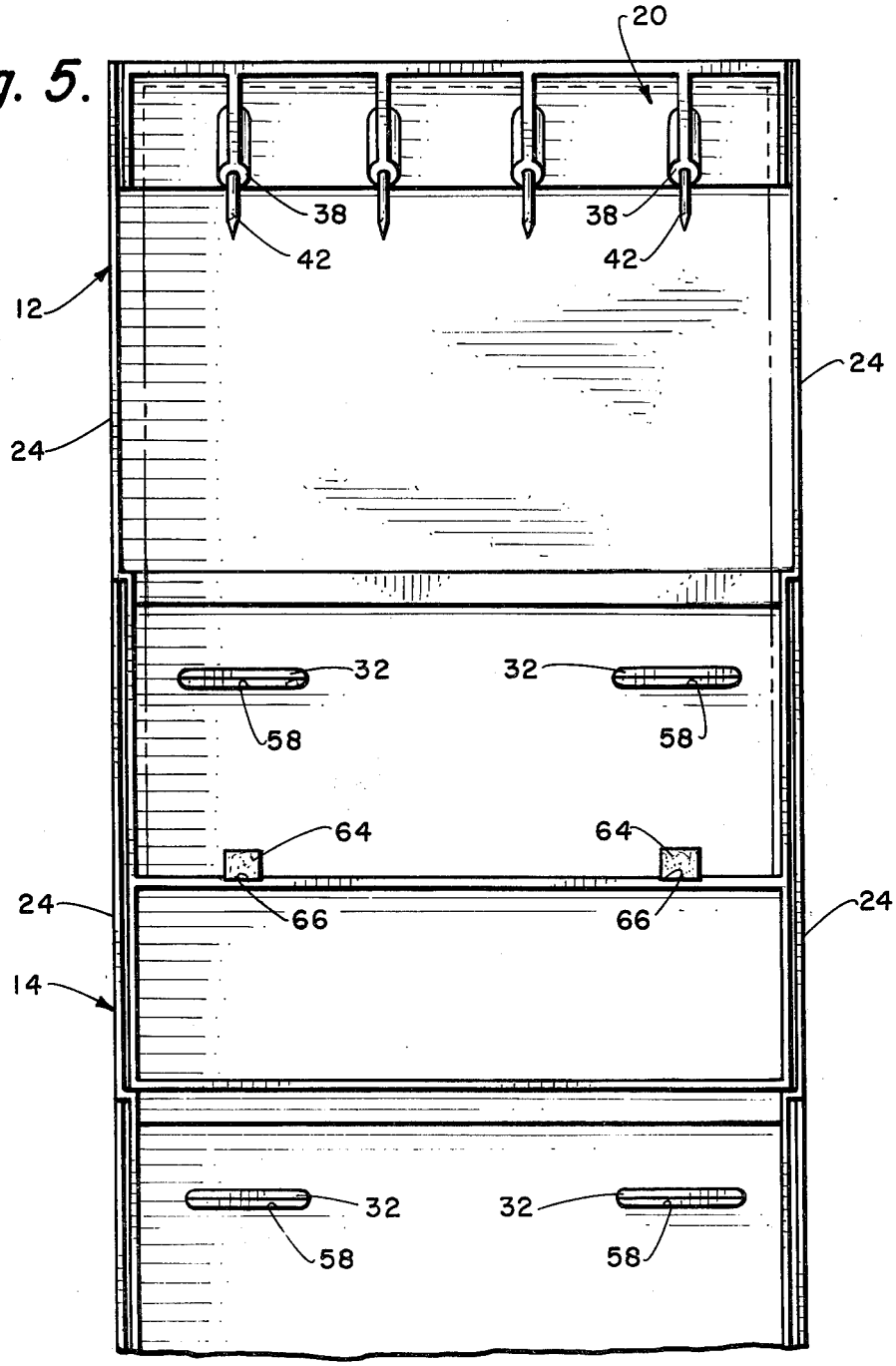
FIG. 5 is a rear elevational view taken on the broken line 5—5 of FIG. 4.
Figure 6:
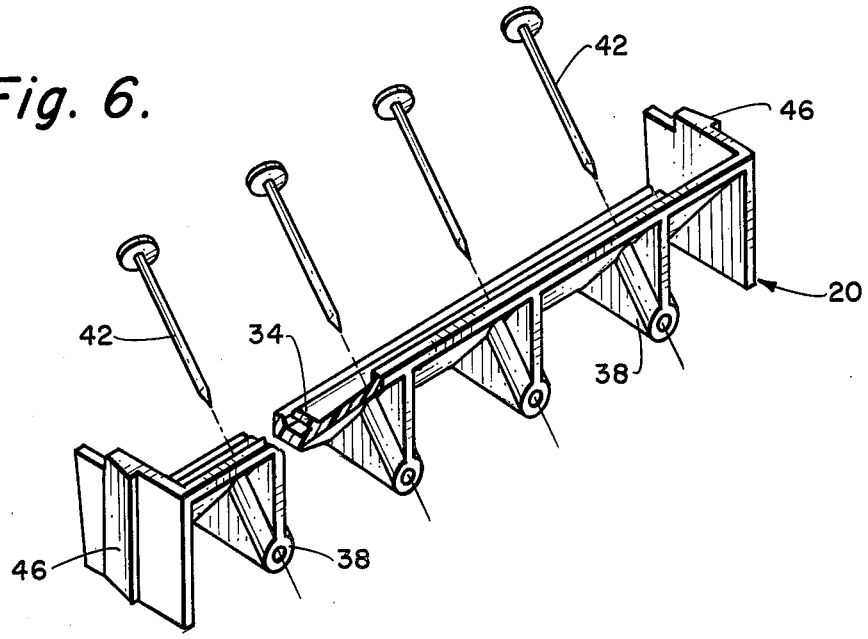
FIG. 6 is an isometric view illustrating one form of supporting means for the primary tray member of the composite letter file.

The primary tray member 12 is distinguished from the secondary tray members 14 primarily by the provision of cooperative supporting means 20, which, as best shown in FIGS. 3, 5 and 6 of the drawings, serves, in a manner to be described in greater detail below, to demountably fix the primary tray member in operative relationship with the vertical wall surface 16 and which serves as the sole means of supporting the entire assemblage of primary and secondary trays of the composite file 10 on the vertical or other surface to which the composite file 10 may be mounted.

The primary tray 12 includes a front wall 22, sidewalls 24 and a bottom wall 26. The primary tray may be fabricated from light metal, polystyrene or similar synthetic plastic materials by the use of sheet metal forming or injection molding processes, and it will be obvious to those skilled in the art that various equivalent materials may be utilized to fabricate the primary tray 12.

Figure 4:
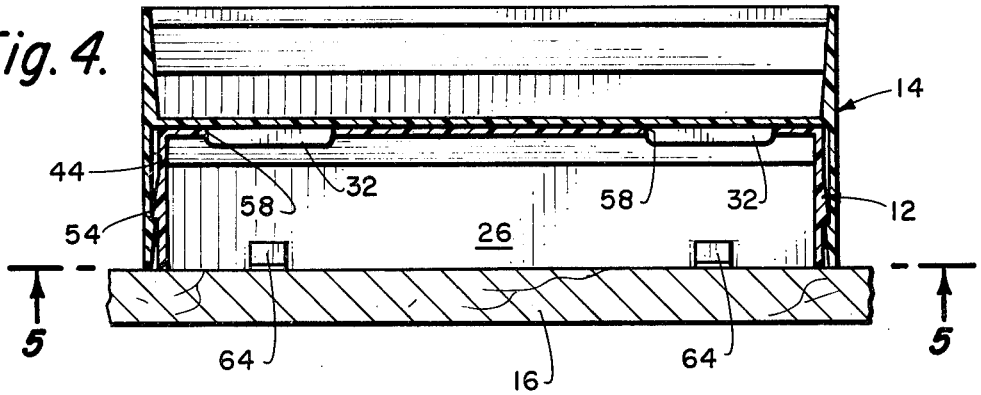
FIG. 4 is a transverse sectional view taken on the broken line 4—4 of FIG. 3.
Figure 8:
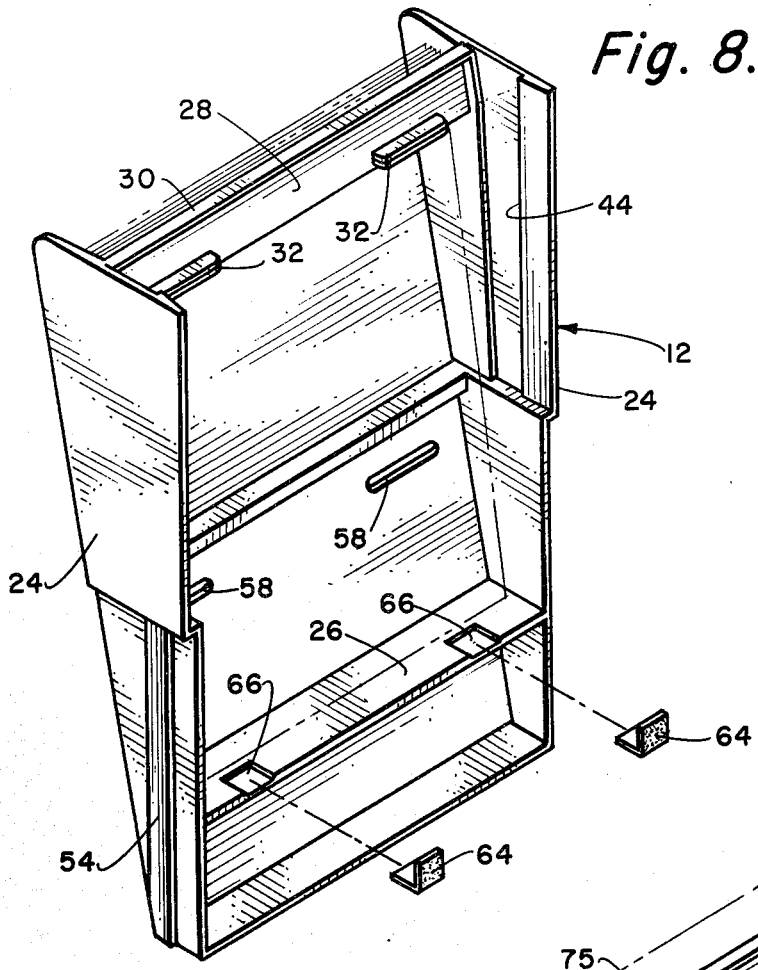
FIG. 8 is an isometric rear view of the tray member.

Of course, a wide variety of synthetic plastics is available and it is not intended to limit the manufacture of the primary tray 12 or the secondary tray 14 to any particular material. Formed integrally with and extending between the sidewalls 24 is a supporting bar 28 cooperative with the supporting means 20. The supporting bar includes a horizontally oriented locating flange 30 and a pair of bifurcated securement tabs 32, as best shown in FIGS. 3, 4 and 8 of the drawings.

The supporting bar 28 engages the supporting means 20, as best shown in FIG. 3 of the drawings, by the engagement of the bifurcated supporting tabs 32 in corresponding receptacles 34 on the supporting means. The supporting means 20 can also be fabricated by injection molding from any desired synthetic plastic or metal stampings and also includes a plurality of nail guides 38 adapted to guide nails or similar fasteners 42 into suspensory relationship with the adjoining vertical suspensory wall structure 16, as best shown in FIGS. 3 and 6 of the drawings.

Although the supporting means 20 is shown as a separate component, it will be obvious to those skilled in the art that the supporting means for the primary tray 12 could be formed integrally therewith and be fabricated in a variety of configurations, and it is not intended that the concept of the invention be limited to the idea that the supporting means 20 is separate from the supporting bar 28.

Formed integrally in the sidewalls 24 and, more particularly, on the inner surfaces thereof are elongated detent receptacles 44 which serve to align and support the primary tray 12 in operative relationship with the supporting means 20 because of the provision on the opposite extremities of the supporting means 20 of elongated supporting and retention ribs 46 which, as best shown in FIG. 6 of the drawings, are adapted to fit within the upper extremities of the elongated receptacles 44.

As will be obvious from the showings of FIGS. 3 and 8 of the drawings, the primary tray 12 opens rearwardly and the adjacent wall or other surface upon which the primary tray 12 is mounted by the supporting means 20 serves as the back wall of the receptacle 52 provided by the front, side and bottom walls of the primary tray 12.

Figure 7:
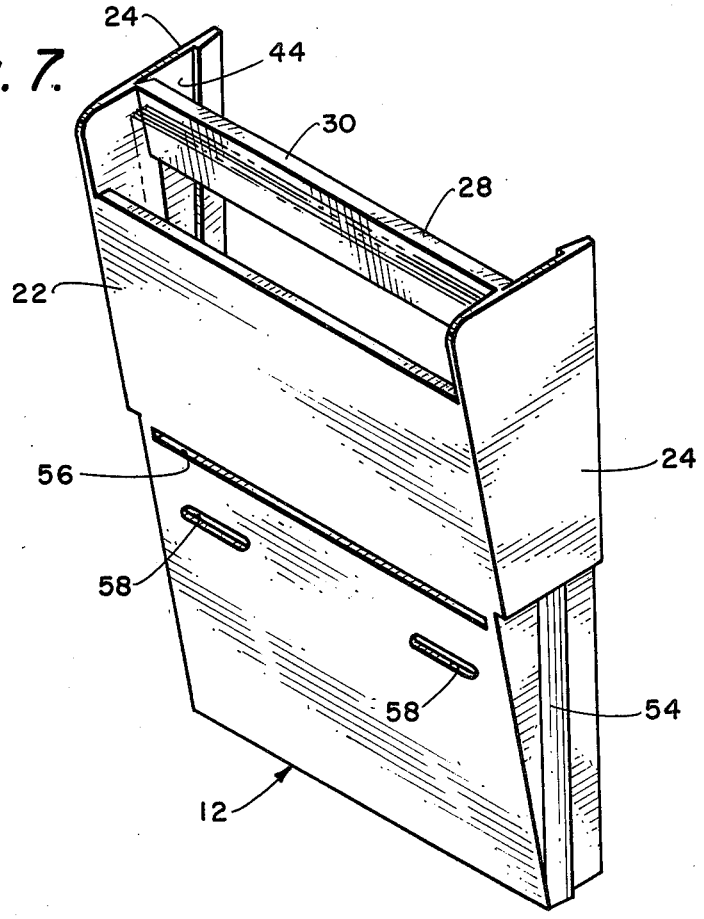
FIG. 7 is an isometric view of the basic tray construction adapted, in conjunction with the supporting means of FIG. 6 to serve as the primary tray member.

Elongated detent and supporting ribs 54 are, as best shown in FIGS. 7 and 8, provided on the lower portions of the sidewalls 24 for a purpose which will be described in greater detail below in discussing the operative relationship of the secondary trays 14 with each other and with the primary tray 12.

The primary tray 12 includes an elongated horizontally oriented receptacle 56 in the front wall 22, as best shown in FIG. 7 of the drawings and also includes a pair of locating slots 58 below the elongated receptacle 56. The functions of the receptacle 56 and slot 58 will be described in greater detail below when considering the operative relationship between the primary receptacle 12 and the secondary receptacles 14.

The secondary receptacles 14 are identical in construction with the primary receptacle with the exception that they are not provided with supporting means 20, which, as previously indicated, can be formed separately from or integrally with the supporting bar 28.

Consequently, it will be noted that the secondary tray members also include supporting bars 28, front walls 22, sidewalls 24 and bottom walls 26. The supporting bars 28 incorporate the continuous horizontal locating flange 30 and the pair of bifurcated locating members 32.

The sidewalls incorporate the detent and supporting receptacles 44 in the upper portions thereof and the elongated detent and locating ribs 54 in the lower portions thereof. Consequently, when it is desired to locate one or more secondary trays 14 in operative relationship with the primary tray 12 and in operative relationship with one another, the upper sidewall portions of the secondary tray 14 are located in overlying relationship with the lower extremity of the primary tray 12 to engage the elongated detent ribs 54 of the primary tray 12 in the corresponding elongated detent receptacles 44 of the secondary tray 14.

This mutual interengagement of the ribs 54 with the receptacles 44 is accomplished by the resilient spreading of the upper extremities of the sidewalls 24 of the secondary tray 14 which permits a snap-like locking action to take place which holds the secondary tray 14 in alignment with the primary tray 12.

Simultaneously, the elongated horizontal rib 30 on the supporting bar 28 is received in the elongated receptacle 56 and the bifurcated tabs 32 are received in the elongated slots 58, as best shown in FIGS. 3 and 4 of the drawings.

It will be noted that the bifurcated tabs 32 are slightly oversized in relationship to the elongated slots 58 so that a compressive effect occurs when the tabs 32 are forced into the elongated slots 58 which materially augments the positive interengagement of the first secondary tray 14 with the primary tray 12 and succeeding secondary trays 14 with one another.

If desired, as best shown in FIG. 8 of the drawings, adhesive pads 64 which fit into receptacles 66 may be provided to insure, as best shown in FIG. 3, securement of the bottom wall 26 in operative engagement with the adjacent supporting surface 16.

Figure 9:
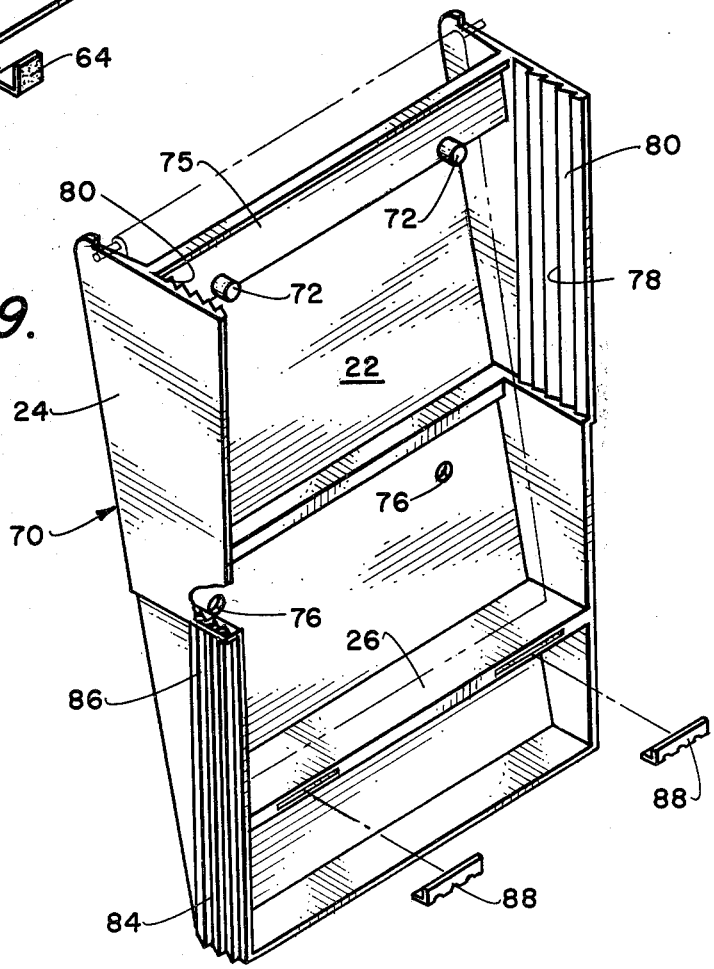
FIG. 9 is an isometric rear view showing an alternative embodiment of the tray member.

An alternative embodiment of the secondary tray of the composite vertical file is illustrated at 70 in FIG. 9. It differs from the previously discussed embodiment in that pegs 72 are provided on a supporting bar 75, said pegs being cooperative with corresponding openings 76 in the front wall 22 of the tray. In the upper portion of the sidewalls 24 a plurality of elongated detent receptacles 78 is provided by means of a multiplicity of serrations 80 which are elongated and which are located on the inner surfaces of the sidewalls 24. On the lower portion of the sidewalls 24 corresponding serrations 84 provide corresponding detent projections 86 which are adapted to interfit in the receptacle 78 of a subtending tray.

In juxtaposing trays 70 in operative relationship with one another the snap action of the sidewalls upper portion occurs so that the serrations can snap into operative engagement with one another. In addition, adhesive tabs 88 are provided which are received in the bottom wall 26 so that the securement of the back of the tray in operative relationship with the adjacent supporting surface may be assured.

It is conceivable that the portion of the trays in both embodiments below the bottom wall 26 may be eliminated since it merely serves to enhance the stable relationship of one tray with another. In addition, it is obvious that alterations and variations of the configuration of the trays may be made without materially departing from the concept of the invention or the scope of the claims.

I claim:

1. In a vertical letter file adapted to be mounted on a supporting surface, the combination of: a primary tray member having parallel sidewalls, a front wall and a bottom wall, support means on the uppermost extremity of said sidewalls for mounting said tray on said supporting surface, and detent means on said sidewalls; and a secondary tray member having parallel sidewalls, a front wall and a bottom wall connected to said sidewalls and detent means on said sidewalls engageable with the detent means on said primary tray member, said detent means on said sidewalls of said secondary tray member being displaceable by said primary tray member and engageable with the detent means thereof by springing into engagement therewith.

2. In a composite letter file which can be mounted on a supporting surface, the combination of: a primary tray member having sidewalls, and front and bottom walls on said sidewalls defining a receptacle for documentary materials, support means on the sidewalls for mounting said composite letter file on said supporting surface, and detent receptacles on said sidewalls; and a secondary tray member having sidewalls and front and bottom walls supported on said sidewalls, detent members on said sidewalls engageable with said detent receptacles of said primary tray member to support said secondary tray member in detachable relationship with said primary tray member, said front, bottom and sidewalls defining a letter receiving receptacle, said detent members on said sidewalls being laterally displaceable with respect to said primary tray member to snap into said detent receptacles thereupon.

3. A composite letter file of the character defined in claim 2 in which said secondary tray member has an open back portion adapted to be disposed in overlying relationship with the front wall of said primary tray member whereby said front wall of said primary tray member closes off the open portion of said secondary tray member.

4. A composite letter file as defined in claim 2 in which said detent receptacles in said primary tray member are constituted by elongated grooves in the sidewalls of said primary tray member and said detent means on said secondary tray member are constituted by projections on the sidewalls of said secondary tray member engageable with said grooves on said primary tray member to detachably mount said secondary tray member from said primary tray member.

5. In a composite vertical letter file adapted to be mounted on a vertically oriented wall surface, the combination of: a primary tray member having front, side and bottom walls defining a letter receiving receptacle, elongated detent receptacles on said sidewalls, and supporting means securable to said primary tray member for supporting said primary tray member from said vertical supporting surface; and a secondary tray member having front, side and bottom walls defining a letter receiving receptacle, said secondary tray member having an open back portion, and elongated detent means on said sidewalls of said secondary tray member engageable with said elongated detent means on said sidewalls of said primary tray member to detachably mount said secondary tray member in operative relationship with said primary tray member, said elongated detent means of said secondary tray member being laterally displaceable to snap into said elongated detent receptacles.

6. A composite letter file of the character defined in claim 5 in which said secondary tray member has its open back portion disposed in overlying relationship with the front wall of said primary tray member when said detent means of said primary and secondary tray members are engaged with one another to close off the open back portion of said secondary tray member.

7. A composite letter file of the character defined in claim 5 in which said elongated detent means on said primary tray member are constituted by a plurality of vertically oriented serrations on the sidewalls of said primary tray member and said detent means on said secondary tray member are constituted by corresponding serrations engageable with the serrations on said primary tray member.

* * * * *